US005947848A

United States Patent [19]

Koole

[11] Patent Number: 5,947,848

[45] Date of Patent: Sep. 7, 1999

[54] BASKETBALL-STAND

[75] Inventor: Peter Marinus Koole, Kloetinge, Netherlands

[73] Assignee: Schelde International B.V., Netherlands

[21] Appl. No.: 08/904,683

[22] Filed: Aug. 1, 1997

[51] Int. Cl.[6] ..... A63B 63/08

[52] U.S. Cl. ..... 473/483

[58] Field of Search ..... 473/479, 481, 473/482, 483

[56] References Cited

U.S. PATENT DOCUMENTS 5,628,508 5/1997 Koole ..... 473/481
5,772,167 6/1998 Koole ..... 473/483 X

OTHER PUBLICATIONS

Schelde International B.V., Catalog, approx. 1983, pp. 607–608.

*Primary Examiner*—William H. Grieb

*Attorney, Agent, or Firm*—Brooks & Kushman P.C.

[57] ABSTRACT

A basketball-stand comprising: a base; at least one support system carried by the base; a beam carried by the at least one support system, the beam is attached to a back-board and basketball-rim, the beam—and thereby the stand—being capable of moving between a storage position and a playing position; and gravity operated mechanism acting upon a point connected to the at least one support system and accumulating potential energy when the stand is lowered to the storage position, wherein the accumulated potential energy is released when the stand is raised to the playing position. Preferably, said gravity operated mechanism is at least one weight adjustably suspended from at least one suspension rod, the end of one weight comprising the point connected to the at least one support system, the at least one suspension rod extending substantially horizontally in its position stand, and vertically in its position corresponding to the playing position of the basketball-stand.

8 Claims, 6 Drawing Sheets

BASKETBALL-STAND

BACKGROUND OF THE INVENTION

The invention relates to a basketball-stand, comprising a base, at least one support system carried by the base, a beam carried by the support system, which beam is attached to a back-board and basketball ring, and the beam—and thereby the stand—being capable of moving between a storage position and a playing position.

STATE OF THE ART

Basketball-stands have been manufactured in various types. One type is entirely manually operated to move it from its storage position to its playing position and back. In practice this is only feasible for very simple and lightweight constructions.

Another type has a hydraulic pumping system to effect the movement between the two positions. This allows for a more heavy structure of the stand. The effort required to operate the hydraulic system is not particularly high, but it requires some time to effect the complete movement.

A further type is intended for the heaviest structure and has power storage means in form of a set of springs, connected between the base and one support system, and accumulating power when the stand is in its storage position, the accumulated power being released when the stand is raised to the playing position. An important advantage of this type is that only a minimum of manual effort is required to move the system between its storage position and its playing position. On the other hand the set of springs and the unavoidable links, contribute considerably to the overall weight of the stand and moreover constitute a factor which increases the cost of manufacturing it.

OBJECTS OF THE INVENTION

The main object of the invention, therefore, is to provide a basketball-stand of a more simplified structure than the one with power storage means and yet allows for a minimum manual effort to raise the stand to its playing position and bring it down again to its storage position.

Another object is to propose a fine-adjustment for the manual effort which, in use, is required to move the stand between its two positions.

SUMMARY OF THE INVENTION

The main object is realized by gravity operated means, acting upon a point connected to said at least one support system and accumulating potentional energy when the stand is lowered to the storage position, the accumulated potentional energy being released when the stand is raised again to its playing position.

In this manner the weight of the movable parts of the basketball-stand—whether directly as weight or in form of a moment of torque originating in the weight proper acting upon a certain arm around a pivot axis—can be balanced to a desired degree.

The gravity operated means is preferably one or more weights, suspended from one or two suspension rods.

The weight or weights are not just added to the stand but can at least partly—spoken in terms of a total mass thereof—be taken instead of balancing weights which are commonly carried by the base in order to balance the back-board and rim as well as the part of the beam which, in the playing position, project forwardly from the line which comprises the most forward support of the base with respect to the ground, generally the front wheels.

It is advantageous when the suspension rod or suspension rods for the weight or weights extend substantially horizontally in the position corresponding to the storage position of the basketball-stand, and extend substantially vertically in the position corresponding to the playing position. In this way the effect of the weight is maximum in the storage position, where in many cases a momentum resulting from the weight of the movable parts is maximum, particularly when, as is most often the case, there are two support systems which pivotally carry the beam, whether or not in such manner that a quadrangular system of links is formed by which the stand can be moved between its two extreme positions.

The resulting moment of torque to be exerted for bringing the basketball stand into its playing position may be finely adjusted by suspending the counterweight blocks in a slightly adjustable manner.

SHORT DESCRIPTION OF THE DRAWINGS

FIG. 1 diagrammatically represents a basketball-stand in side view, in its lower or storage position,and provided with gravity operated means according to the invention by which, to a desired extent, the moment of torque can be balanced.

FIG. 4 is a partial vertical section according to the arrows IV—IV in FIG. 2;

FIG. 5 represents part of the basketball-stand to the right hand side of said section line IV—IV.

FIG. 6 is a partial vertical section according to the arrows VI—VI in FIG. 1;

FIG. 7 represents part of the basketball-stand to the right hand side of said section line VI—VI in FIG. 1.

DESCRIPTION OF THE PREFERRED EMBODIMENT

Figure 1:
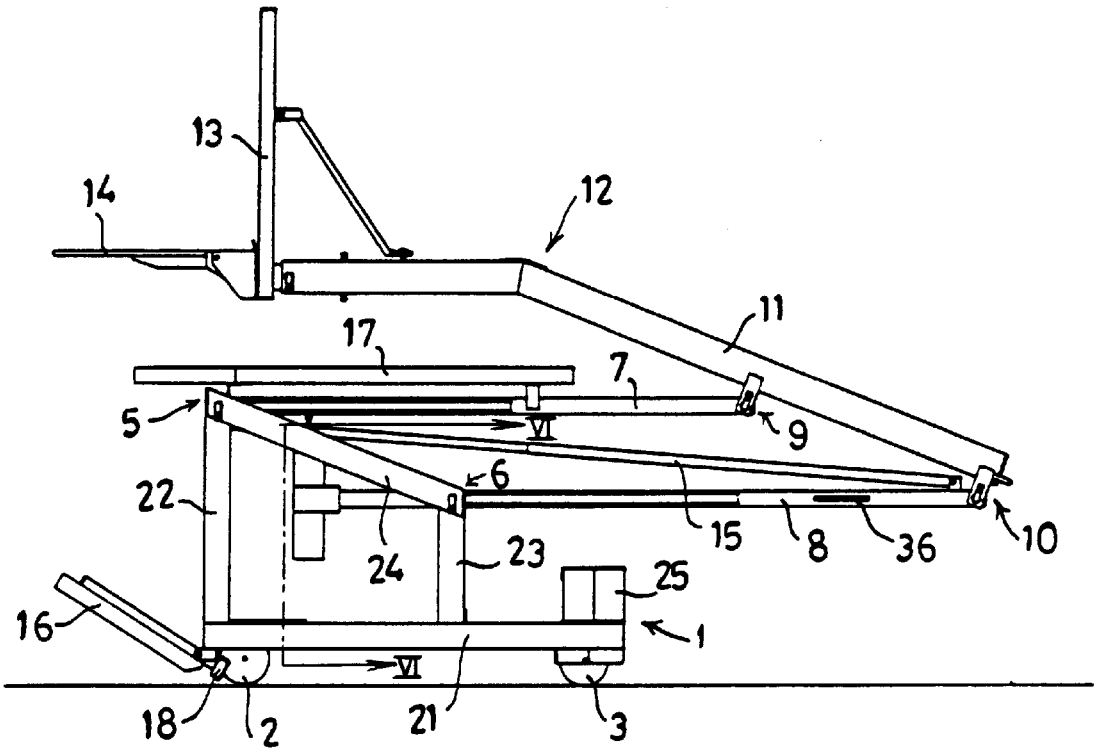
Figure 2:
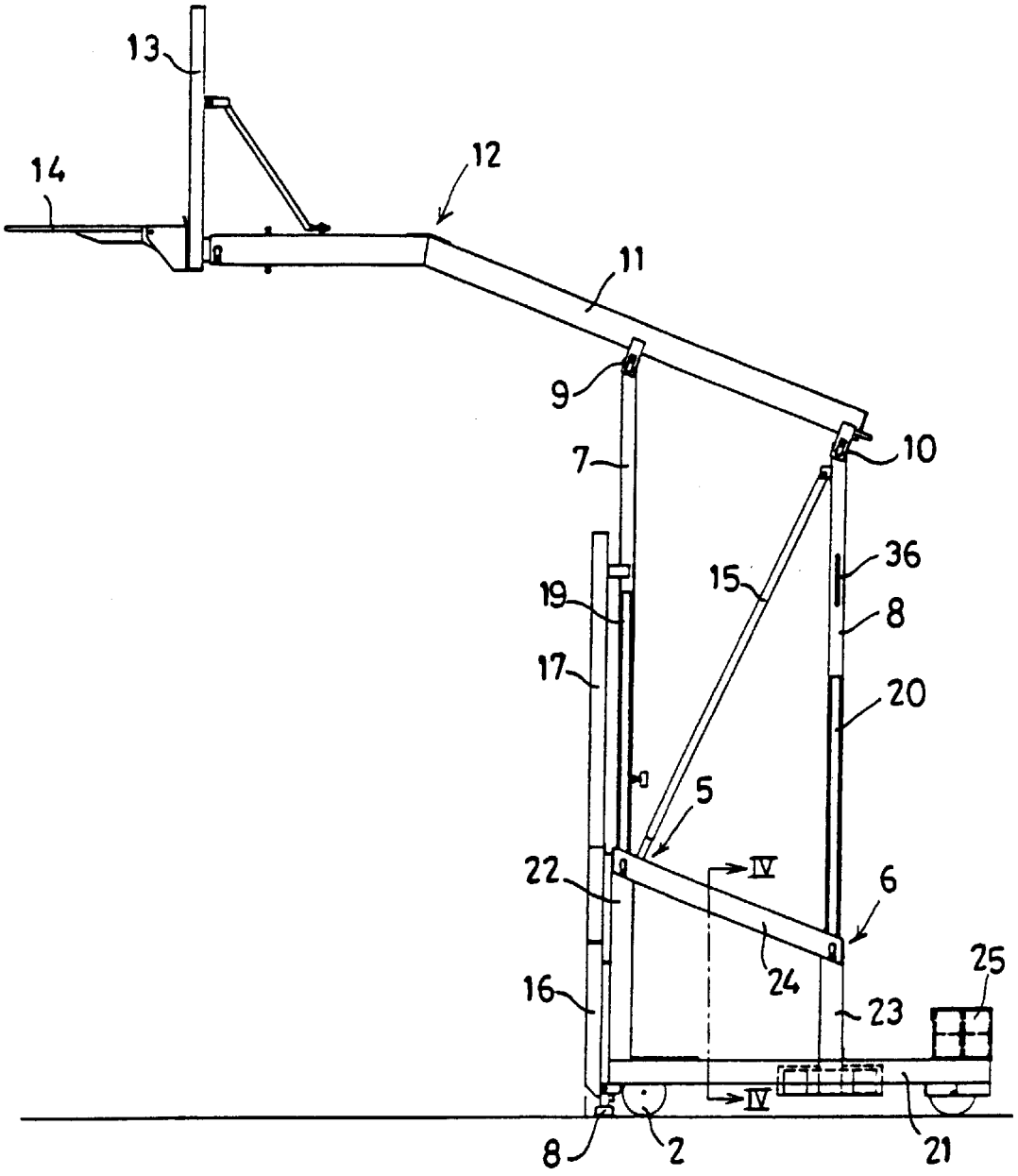
FIG. 2 represents the basketball-stand in the same embodiment and in the same side view in its highest or playing position.

The main structural elements of the basketball-stand, and the manner in which they cooperate, appear form the diagrammatical representation of FIGS. 1 and 2. A base is designated by 1, the frame of which carries a pair of rear wheels 2 and a pair of front wheels 3, by which the stand is capable of rolling over floor 4.

A front pivot axis 5 and a rear pivot axis 6 carried by bearings, mounted in the frame of base 1, enable a front yoke 7 and a rear yoke 8, respectively, to pivot with respect to base 1.

The opposite ends of yokes 7 and 8 are similarly capable of pivoting, in bearings 5 and 8, respectively, fixedly attached to a beam element 11 which constitutes part of what is called the beam 12 of the stand. Beam 12 at its far end, is provided with means for attachment of the backboard 13 and the dunk ring or basketball ring 14.

Returning to the pivoting system: in this preferred embodiment the four pivot axes of the respective pivot pins are all parallel to one another, oriented perpendicularly to the sheet of the drawing, so that yokes 7, 8, the part of the base between the lower pivot axes 5, 6 and the part of beam element 11 between the pivot axes of the bearings 7, 8, form a quadrangular system of links. This quadrangular system of links allows beam 12 to move with respect to base 1, from the position of FIG. 1—the storage position—to the position of FIGS. 2 and 3—the playing position. Diagonally arranged between the yokes inside the system of links is a telescoping rod 15 which can be used to stabilize the system of rods in the storage position, in the playing position, and in any intermediate position as well.

Base 1 at it front side hingeably carries part 16 of a padding plate, and another part 17 of a padding plate is attached to front yoke 7.

Figure 3:
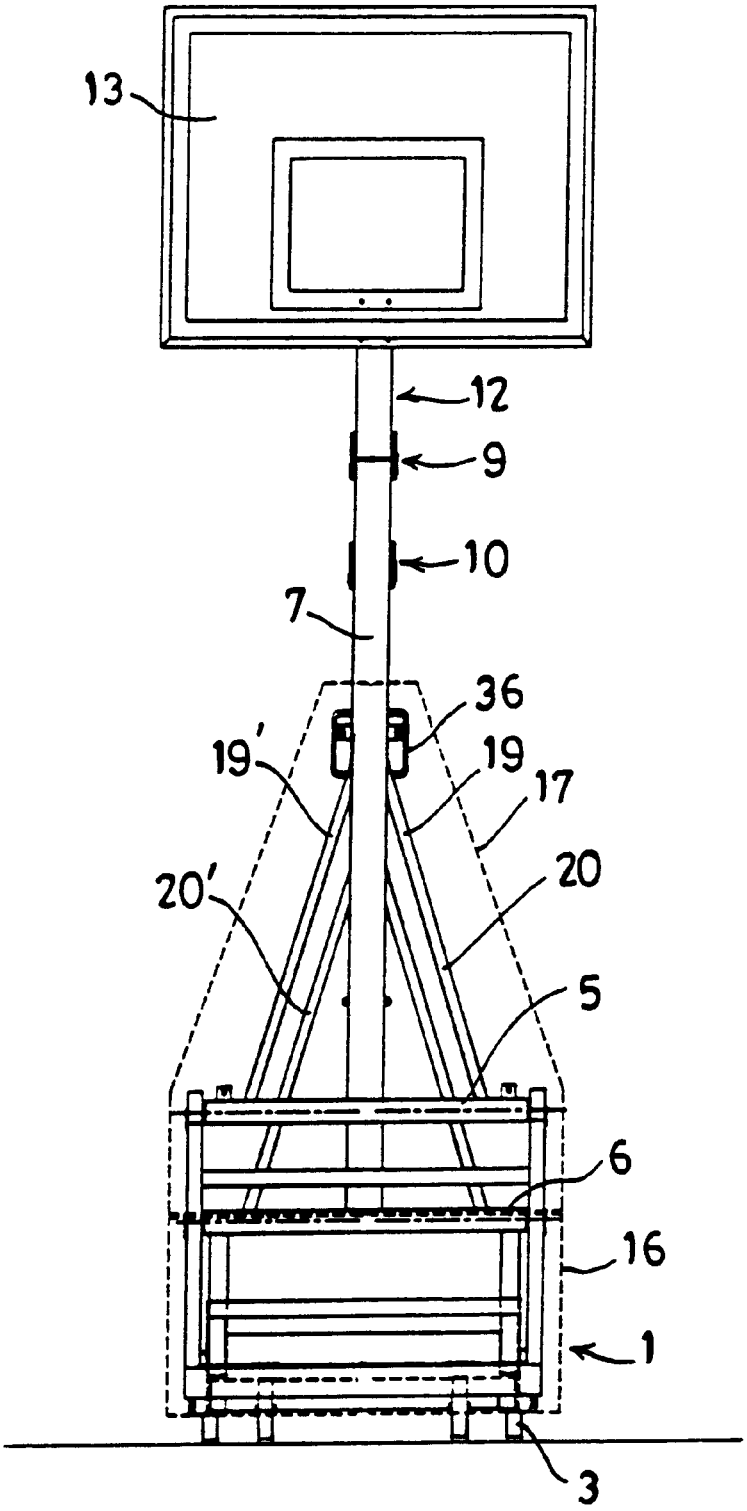
FIG. 3 represents the same embodiment of the basketball-stand in front view.

When the basketball stand is brought—yet to be described in detail—from the storage position of FIG. 1 to the playing position of FIGS. 2 and 3, padding parts 16 and 17, complete each other and form a complete shielding, indicated by broken lines in the front view of FIG. 3, which prevents players or ball from entering into contact with the support mechanism. This shielding 16, 17 is represented only in broken lines in FIG. 3 in order to keep further details both of the base and of the support system visible.

Lower padding part 16 near its bottom end carries a pair of feet 18 which, in the normal upright position of element 16 like during playing, shown in FIG. 2, will rest upon the floor so as to lift front wheels 2 a little, thus preventing easy rolling away of the whole basketball stand in its playing position. When padding part 16 is swung into the open position as represented in FIG. 1, feet 18 are free from the floor and front wheels 2 will instead contact the floor, so that in the storage position the basketball stand can be rolled away if desired.

From the front view of FIG. 3, it is visible that front yoke 7 further comprises two reinforcement rods 19, 19', welded or otherwise fixedly attached to front pivot axis 5, extending obliquely upwards and at their upper ends being again welded or similarly fixedly attached to yoke 7. By this structure the whole constructed of pivot axis 5, yoke 7 and reinforcement rods 19, 19' has an appreciable stiffness and gives stability to the back-board 3 and the rim carried thereby. Similarly reinforcement rods 20, 20', affixed to rear pivot axis 6 and rear yoke 8 of which only the lower part is visible in the front view of FIG. 3, provide stability to rear yoke 8.

Returning to the base 1 in detail, it is constructed upon a substantially rectangular bottom frame 21. On either side front posts 22 and rear posts 23 are rigidly attached to bottom frame 21, such as by welding. To the tops of these posts upper side beams 24 are fixedly attached, again such as by welding. Front pivot axis 5 and rear pivot axis 6 are in bearings which are carried by these beams 24. Front posts 22 are somewhat higher than rear posts 23, resulting in an oblique position of upper side beams 24, and this again allows for the parallellepiped condition of the quadrangular system of links described above, in the storage position represented in FIG. 1.

The basketball stand described sofar has been known in its essential parts, with some variations in structure and dimensions of base 1 as well as of the quadrangular system of links 7, 8, 24, 11, beam 12, the type of bearings used and such things which are all known to the men skilled in this art and are not yet related to the invention.

Also known is the fact that bottom frame 21 of base 1 extends rearwardly somewhat further than rear posts 23 which support rear pivot axis 6, as is visible from FIGS. 1 and 2. Not only is thereby the wheel base extended, resulting in greater stability, but particularly this is an effective way of carrying counterweights 25, which serve to balance the weight of the forwardly projecting beam 12 with the inherent weight thereof as well as the weight of board 13 and ring 14.

Figure 4:
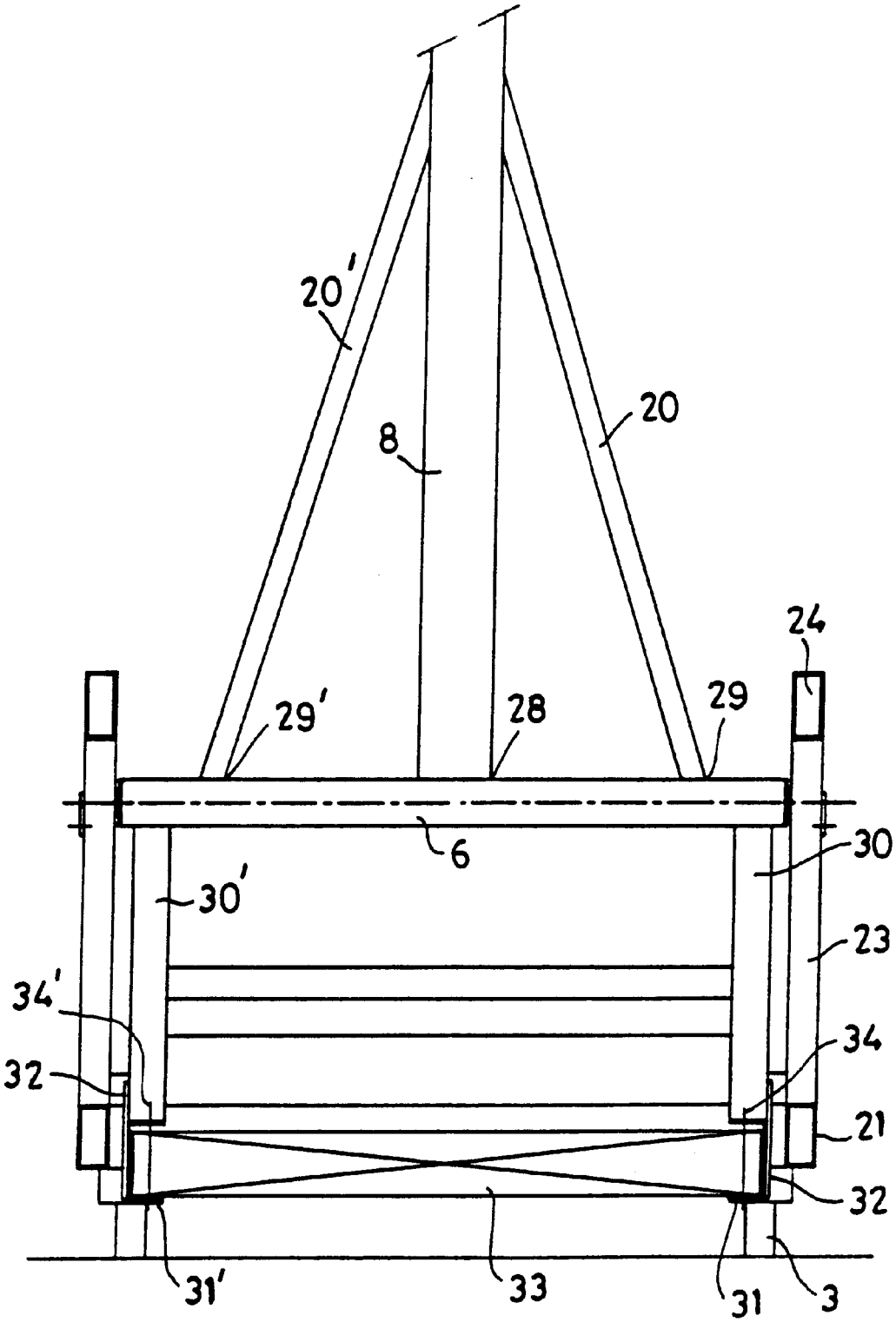
FIGS. 4 to 7 represent details on a larger scale.
Figure 5:
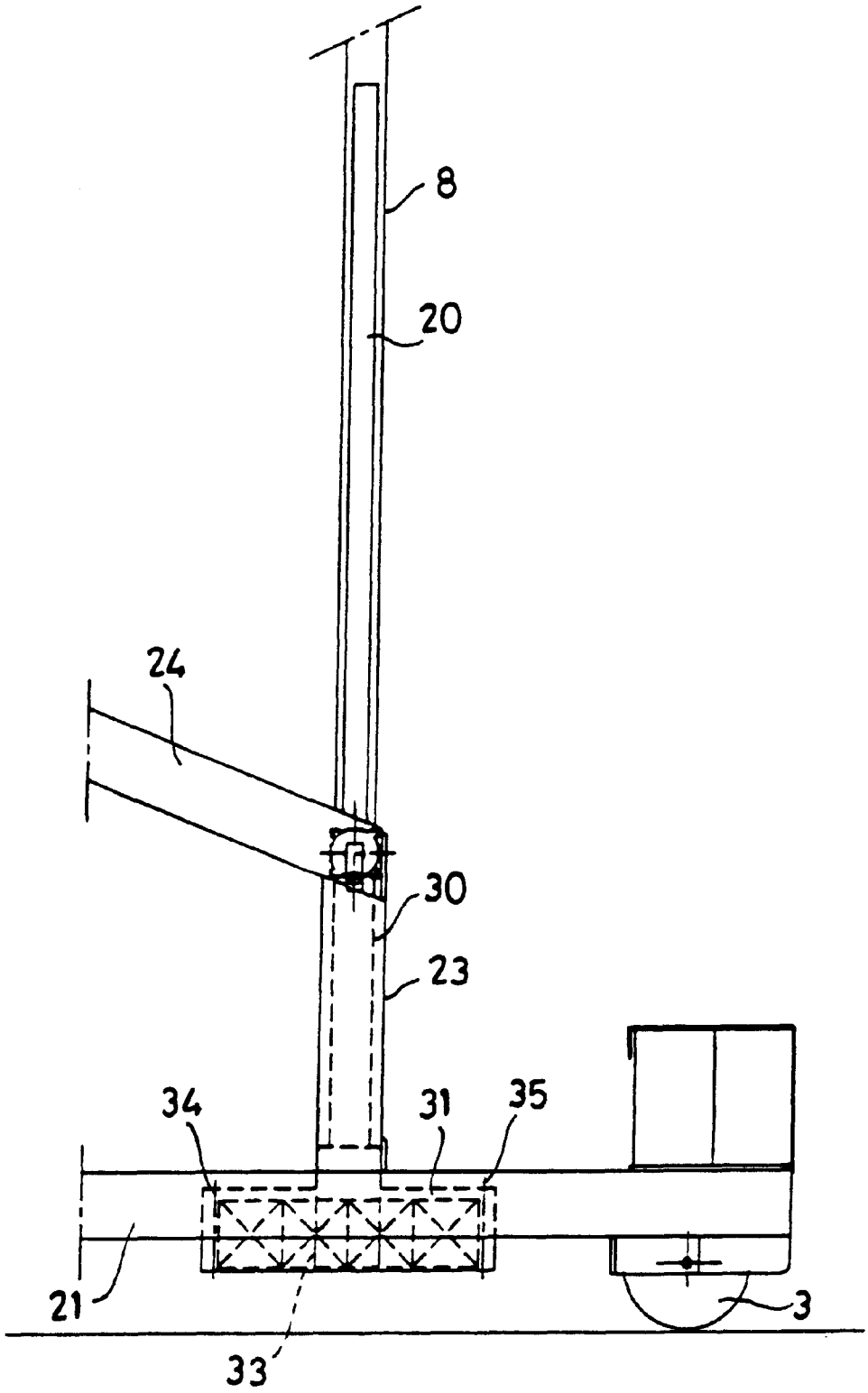
Figure 6:
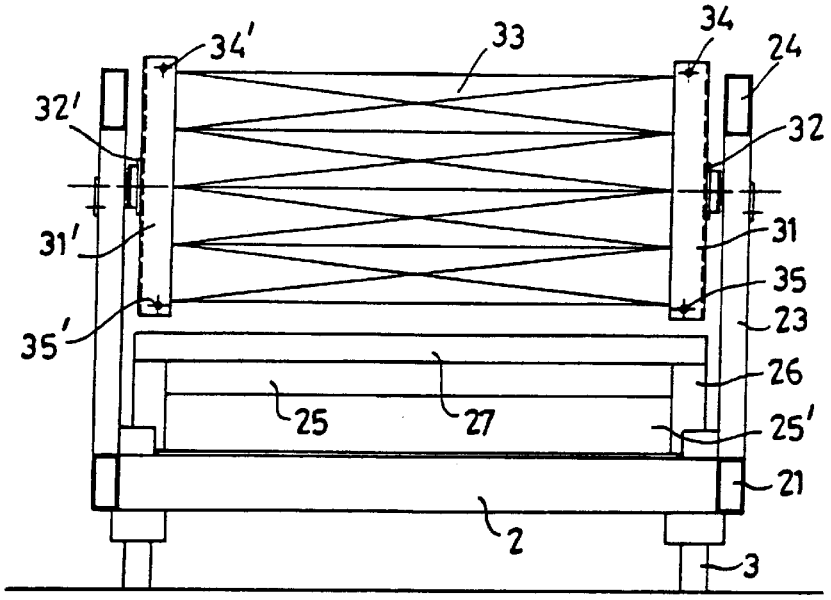
Figure 7:
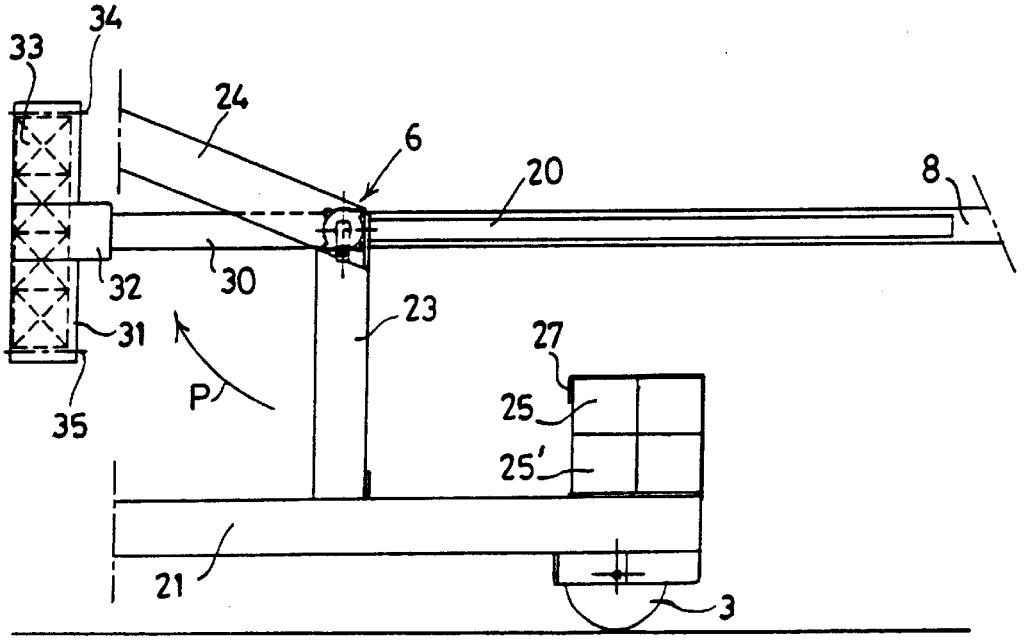

FIGS. 4 to 7 show more details of this than FIGS. 1 to 3 do. FIGS. 4 and 6 are vertical partial sections, and therefore show the structure in its playing position and its storage position, respectively, as views according to arrows IV—IV in FIG. 2 and VI—VI in FIG. 1. FIG. 5 shows, at the same enlarged scale as FIG. 4 does, the part at the right hand side of the section line IV—IV. Similarly FIG. 7 shows the part at the right hand side of the section line VI—VI.

Those FIGS. 6 and 7 show the known way of arranging counterweights 25. In actual practice there may be a few rectangular blocks such as 25, 25' one upon the other, and in this case there are two such pairs, like FIG. 7 shows, and all blocks are enclosed by a housing which engages the counterweight blocks at their ends, as indicated in FIG. 6 by 26, and engaging the blocks from the top as indicated by 27.

The features of the present invention will now be described with reference to FIGS. 4–7.

It is recalled that FIG. 4 shows the rear pivot axis 6 to which rear yoke 8 is fixedly attached, preferably welded, at the place indicated by 28. Similarly reinforcement rods 20 and 20' are welded to pivot axis 6 at places 29, 29'. According to this invention also attached to front pivot axis 6, to wit close to the opposite ends thereof, are suspension rods 30 and 30'. In the preferred embodiment shown, these suspension rods extend parallel to or coplanair with yoke 8 and reinforcement rods 20, 20', implying that they are in vertical position when yoke 8 is in its vertical or playing position (FIGS. 1 and 5).

Fixedly attached to the bottom ends of suspension rods 30, 30' are U-sections 31, 31' with their openings directed towards each other as shown in FIG. 4. The length of U-sections 31, 31' appears from the side view of FIG. 5. In order to reinforce the connection between each of the U-sections 31, 31' and the associated suspension parts 30, 31', gusset plates 32, 32' are provided.

U-sections 32, 32' serve to hold a number of counterweight blocks 33. FIG. 5 indicates, in broken lines, that in the embodiment represented there are four such blocks. The actual number and the sizes thereof will depend on the details of the structure of the basketball-stand, as will be made more clear below. Counterweight blocks 33 may be held by a pair of front bolts 34, 34' and a similar pair of rear bolts such as 35 which, in order to prevent overloading of FIGS. 4 and 5, have only been indicated by their center lines. As shown, these bolts are provided through the two opposite legs of U-sections 31, 31'.

FIGS. 6 and 7 show the position of the elements just described when the basketball-stand has moved to its storage position. Yoke 8 and suspension rods 30 (and 30') are now horizontal, and the mass of counterweights 33, held by U-sections 31, 31' and bolts 35, 35', has swung upwardly as indicated by arrow P in FIG. 7.

The counterweights 33 now exert a moment of torque around pivot axis 6 counterclockwise as seen in FIG. 7, which will counterbalance the moment of torque exerted about axis 6 by the weight of not only yoke 8 but in fact the whole support structure of beam 12 including board 13 and ring 14. It is even feasible that the mass of counterweights 33 will more than outweigh the momentum in clockwise direction exerted by the beam and its support structure so that the beam will be brought into its playing position unless it is kept in its storage position by some fixation means. The inventor prefers, however, to dimension the counterbalancing system in such manner that the basketball stand will of itself remain in its storage position but requires only a little manual force to be exerted on a grip such as 36 (see FIGS. 1 to 3) affixed to rear yoke 8 in order to initiate the swinging movement of the basketball-stand from its storage to its playing position.

It will now be understood that in the horizontal position of suspension rods 30, 31 in the storage position of the basketball-stand, the moment of torque exerted by counterweights 33 is at maximum, because gravity acts vertically downwardly and the momentum arm towards the axis of rotation is horizontal. To the extent that yoke 8 starts moving up, and therefore suspension rods 30, 30' start moving down, the angle between the force of gravity and the arm of the momentum deviates from 90° so that the moment will decrease according to the well known sinelaw, until the moment of torque reaches the zero value when suspension rods 30, 31 have arrived in their vertical positions, right below the axis of rotation. The same process of decrease of the moment of force occurs, however, to the extent that yoke 8, the remainder of the support structure and the beam 12 move upwardly until they reach their final playing position according to FIG. 2 (and FIGS. 4 and 5, for that matter). Therefore the ratio between the moment of torque exerted by the counterweights 33 in counterclockwise sense and the moment of torque exerted by the remainder of the system in clockwise sense will remain the same, but this will result in a decrease of the manual force which will be required to bring the basketball-stand from its storage position into its playing position to the extent that it comes nearer to its playing position. In the playing position the system will be blocked by appropriate action of telescoping rod 15.

In firstly, when the blocking pressure in telescoping rod 15 is removed again, a slight manual force to grip 36 or any other part of the system will be sufficient to get it moving down into its storage position under the action of the moment of torque clockwise to the extent that is exceeds, at any moment, the moment of talk counterclockwise exerted by the counterweight 33. For the sake of security, as a matter of course, there may also be provided some fixed actions means in the storage position. This may be a simple chain or belt.

The resulting moment of torque to be exerted for bringing the basketball stand into its playing position may be finely adjusted by some provision in the exact positioning of the counterweight blocks 33 in U-sections 31, by which the effective moment arm is changed a little. A number of thin washer plates to be arranged either between the individual counterweight blocks or between one end block in the row and the associated bolts 34 of 35 will be an appropriate means in this respect.

It is observed that, although the support system for the basketball stand comprising a system of links 7, 8, 24, 11 which is an exact parallellogram, resulting in a vertical position of board 13 in two extreme conditions and in any intermediate condition of the stand, is no prerequisite for the invention. The invention can also be applied when the system of rods is not parallepiped shaped or when the support system for beam 12 is no system of links at all. Also the horizontal and vertical extreme positions of the suspension rods 30, 30' are only preferred because in the opinion of the inventor it gives the most favourable result, this may also be dimensioned otherwise provided, of course, that the counterweight 33 will keep exerting a moment of torque in one sense which will, at least to the greater part, balance the moment of torque exerted by the beam and its support system in the other sense.

The inventive idea is, basically, to have gravity operated means acting upon a point connected to said at least one support system and accumulating potentional energy is released when the stand is raised to the playing position. This need not be realizes by one or more weights suspended from rods connected to an axis, but also by weights suspended from, for example, cables connected to the mechanical system which supports the beam and by which the transition between the storage position and the playing position is obtained.

What is claimed is:

1. A basketball-stand comprising, in combination:

a backboard and basketball-rim assembly;

a base;

at least one support system carried by the base;

a beam carried by the at least one support system and having said backboard and basketball-rim assembly mounted thereon and moveable between a lowered storage position and a raised playing position; and gravity operated means acting about a pivot point connecting said at least one support system to the base, and accumulating potential energy when said beam and associated assembly is lowered to the storage position, and returning the accumulated potential energy to assist in raising the beam and associated assembly on the base when the same are raised to the playing position.

2. The basketball-stand as in claim 1, wherein said gravity operated means is at least one weight suspended from said at least one suspension rod, the end of said at least one suspension rod opposite said at least one weight comprising said point connected to said at least one support system, said at least one suspension rod extending substantially horizontally in its position corresponding to the storage position of said beam and said assembly.

3. The basketball-stand as in claim 1, wherein said gravity operated means is at least one weight suspended from at least one suspension rod, the end of said at least one suspension rod being disposed opposite said at least one weight comprising said point connected to said at least one support system, said at least one suspension rod extending substantially vertically in its position corresponding to the playing position of said beam and associated assembly.

4. A basketball-stand as in claim 1, wherein the at least one support system comprises two support systems which pivotally carry said beam, all pivotal connections having their axes parallel to one another so that a quadrangular system of links is formed by which said beam and associated assembly may be moved between the storage position and the playing position.

5. The basketball-stand as in claim 1, wherein said gravity operated means is at least one weight suspended from said at least one support system on the opposite side of said pivot point therefrom.

6. The basketball-stand as in claim 1, wherein said gravity operated means is at least one weight adjustably suspended from said at least one support system on the opposite side of said pivot point therefrom.

7. A basketball-stand comprising:

a base;

two support systems carried by the base and each configured as a parallelogram linkage;

a beam carried by said two support systems and having an associated backboard and basketball-rim assembly;

said two support systems pivotally carrying said beam and associated assembly for movement between a lowered storage position and a raised playing position;

at least one weight;

at least one suspension rod with the weight mounted on one end thereof and with the opposite end of the rod connected to one of the two support systems on the opposite side of a pivot point; and said at least one suspension rod extending substantially horizontally when in its position corresponding to the storage position of the beam and associated assembly, thereby balancing at least partially the moment of torque created by said support systems and said beam and associated backboard and basketball-rim assembly.

8. A basketball-stand as in claim 7, wherein said at least one suspension rod is two suspension rods, fixedly attached to the axis of rotation of one of the two support systems relative to said base, said at least one weight being suspended by its ends from said suspension rods.

* * * * *